United States Patent [19]

Golden

[11] 4,079,640

[45] Mar. 21, 1978

[54] PIPE MAKE UP DEVICE

[76] Inventor: R. L. Golden, 101 Mire St., Houma, La. 70360

[21] Appl. No.: 733,342

[22] Filed: Oct. 18, 1976

[51] Int. Cl.[2] ..... B25B 17/00

[52] U.S. Cl. ..... 81/57.17; 173/164

[58] Field of Search ..... 81/57.17, 53 R, 57.2; 166/85; 173/164

[56] References Cited

U.S. PATENT DOCUMENTS

| | | | |
|---|---|---|---|
| 2,784,626 | 3/1957 | Paget | 81/53 R |
| 3,906,820 | 9/1975 | Hauk | 81/57.17 |

*Primary Examiner*—James L. Jones, Jr.

*Attorney, Agent, or Firm*—Fleit & Jacobson

[57] ABSTRACT

A device adapted to be used in conjunction with conventional pipe tongs for rapid make up of drill pipe joints. The device is pneumatically driven, and utilizes a flexible belt to engage a section of drill pipe and to spin the same until substantial resistance to further spinning is experienced. This resistance occurs when the pipe joint is reasonably tight, at which time the make up device automatically cocks the associated pipe tongs. The device includes a belt and pneumatically actuated pivot arm arrangement whereby drill pipe of varying sizes can be effectively handled, and whereby the drill pipe is held in operative association with the belt through the application of minimum holding force.

15 Claims, 6 Drawing Figures

PIPE MAKE UP DEVICE

BACKGROUND OF THE INVENTION

When drilling for oil and the like, it is necessary to drill deep into the ground. Accordingly, the practice is to make up a string of drill pipe from a plurality of pipe sections, with the sections being connected together at the surfaces of the well through the means of threaded joints.

A two-step procedure is generally employed when making up a string of drill pipe. The first step is the initial spinning of the above-ground section of pipe relative to the section extending into the ground until the mating threads "bottom out". The second step involves the use of pipe tongs to generate the substantial tightening torque necessary to maintain the integrity of the string during the drilling operation.

The most commonly employed technique of spinning the above-ground drill pipe through the initial five or so turns involves the use of chains. A chain is manually whipped around the drill pipe, and is then retracted, with the friction developed during the retraction of the chain spinning the upper pipe relative to its mating in-ground pipe. It has long been known that the use of heavy chains to perform the initial pipe spinning operation is quite dangerous. Indeed, many serious injuries from back-lashing chains have been inflicted.

Attempts have previously been made to eliminate some of the dangers involved in the initial spinning of drill pipe by mechanizing the spinning operation. See, for example, U.S. Pat. Nos. 1,505,007, 1,615,695, 2,615,681, 2,746,329 and 2,784,626. Of these, U.S. Pat. No. 2,615,681 issued to True on Oct. 28, 1952 is deemed to be the most advanced.

The True patent discloses a mechanized pipe spinning device mounted above tonging means, and utilizes a continuous belt, chain or other metallic member to automatically spin the drill pipe. The True device purports to accomplish the goal of eliminating human intervention and the use of dangerous chains for initial makeup operations, yet the True device is quite cumbersome, costly and prone to failure.

It is toward the improvement of the above-noted prior art techniques and devices that the present invention is directed.

SUMMARY OF THE INVENTION

The present invention relates to a pipe spinning device adapted to be mounted atop a conventional set of rotary pipe tongs. More particularly, the inventive device is pneumatically operated, includes an endless belt for spinning the drill pipe, and serves to screw mating joints of drill pipe to a point where the finishing torque can be applied by the conventional pipe tongs.

The endless belt which spins the drill pipe is supported by a pair of pivoting arms at the forward end of the device, and associates with a pneumatic motor located at the rear of the device. The arms are pivoted by means of air cylinders acting on the belt. The pivot axes of the supporting arms are located outside the turning radius of the drill pipe, and in this manner, the reactive force exerted on the turning belt by the drill pipe urges the arms in such a direction as to maintain a solid grasp on the drill pipe with minimum holding force from the air cylinders. When the support arms are pivoted inside the respective pivot axes, the endless belt encircles the majority of the circumferential surface of the drill pipe.

The inventive pipe make up device and its associated pipe tongs are free to turn relative to the drill pipe once the respective threads of the joint bottom out. This automatically cocks the pipe tongs until the dead line is taut. The necessary final tightening torque is then applied by pulling the jerk line attached to the arm end of the pipe tongs by means of a conventional cat head.

It is accordingly a principal object of the present invention to provide a pipe make up device for rapidly and efficiently screwing the joints of drill pipe to a point where the finishing torque can be applied by means of conventional pipe tongs.

Another object of the present invention is to provide a pipe make up device which automatically cocks associated conventional pipe tongs for applying the final tightening torque.

Another object of the present invention is to provide a pipe make up device including an air cylinder whose stroke in such that drill pipe of varying sizes can be screwed together without adjustment of the device.

Still a further object of the present invention is to provide a pipe make up device utilizing a flexible endless belt, thus minimizing damage to drill pipe and risk of injury to attendant personnel.

A further object of the present invention is to provide a pipe make up device utilizing an endless belt mounted on pivotable arms for maintaining the belt in tension with minimum holding force.

Another object of the present invention is to provide a pipe make up device utilizing an endless belt which is mounted so as to be urged into engagement with the pipe being spun during the spinning operation.

Yet a further object of the present invention is to provide the combination of conventional pipe tongs and a simple and yet effective pipe make up device for tightening pipe joints to an initial torque.

These and other objects of the present invention, as well as many of the attendant advantages thereof, will become more readily apparent when reference is made to the following description, taken in conjunction with the accompanying drawings.

DETAILED DESCRIPTION OF THE DRAWINGS

Figure 1:
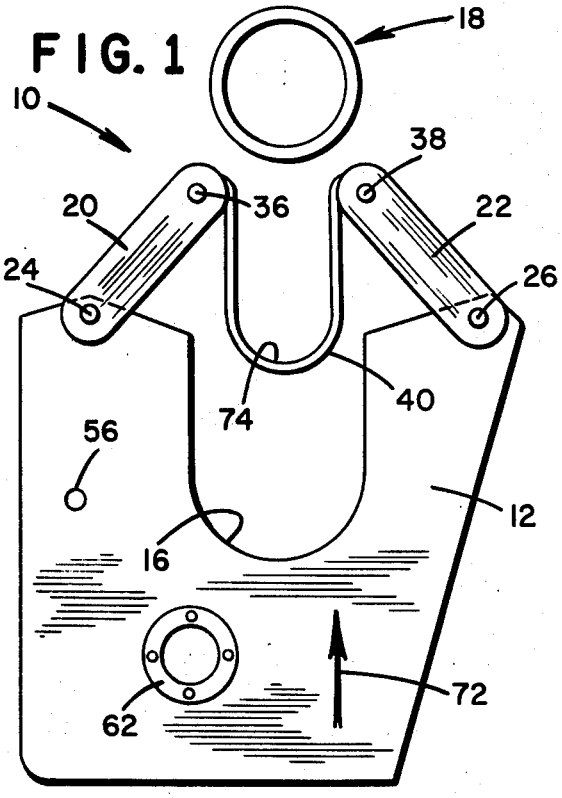
FIG. 1 is a plan view of the inventive pipe make up device in a position ready for association with a section of drill pipe.

With reference first to FIGS. 1 through 5, the basic configuration of the inventive pipe make up device will be described. The make up device is shown generally at 10, and includes a frame, or housing defined by a top plate 12 and a bottom plate 14. As seen best in FIGS. 1 and 2, the top plate 12 and the bottom plate 14 define a vertical recess 16 which is adapted to receive a section of drill pipe shown generally at 18. Support arms 20 and 22 are U-shaped in cross section (see FIG. 4), and are pivotally mounted between top plate 12 and bottom plate 14 by means of respective pivot pins 24 and 26.

Pivot pins 24 and 26 also serve as shafts for rotatably mounted pulleys 28 and 30, respectively. The respective ends of support arms 20 and 22 remote from pulleys 28 and 30 support pulleys 32 and 34 which are mounted for rotation about shafts 36 and 38. A flexible, endless drive belt 40 is supported for movement by the respective pulleys 28, 30, 32 and 34, and extends toward the rear of the make up device 10 where it associates with a drive pulley 42 fixedly mounted on a shaft 44.

Figure 3:
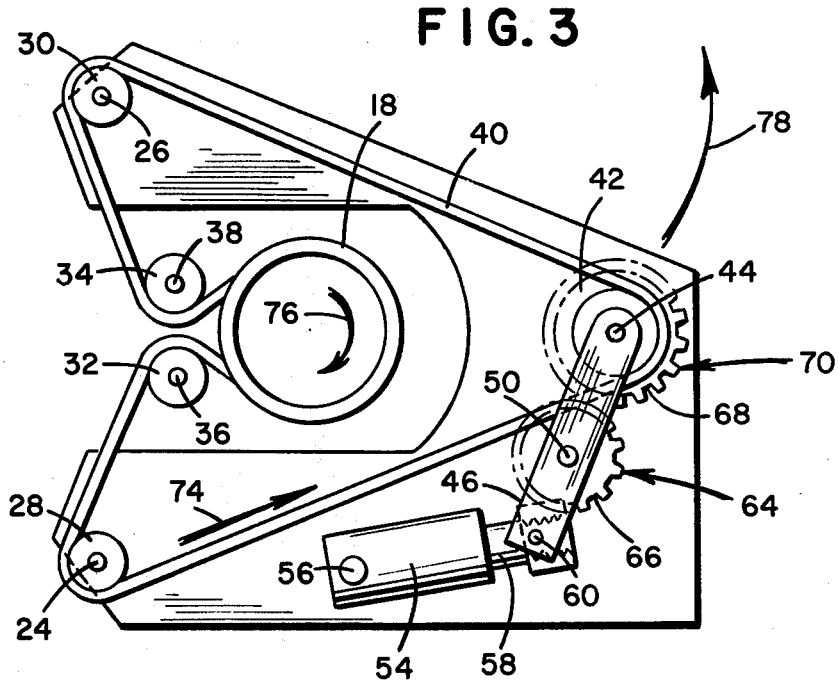
FIG. 3 is a top cross section of the inventive pipe make up device illustrated in FIG. 2.
Figure 5:
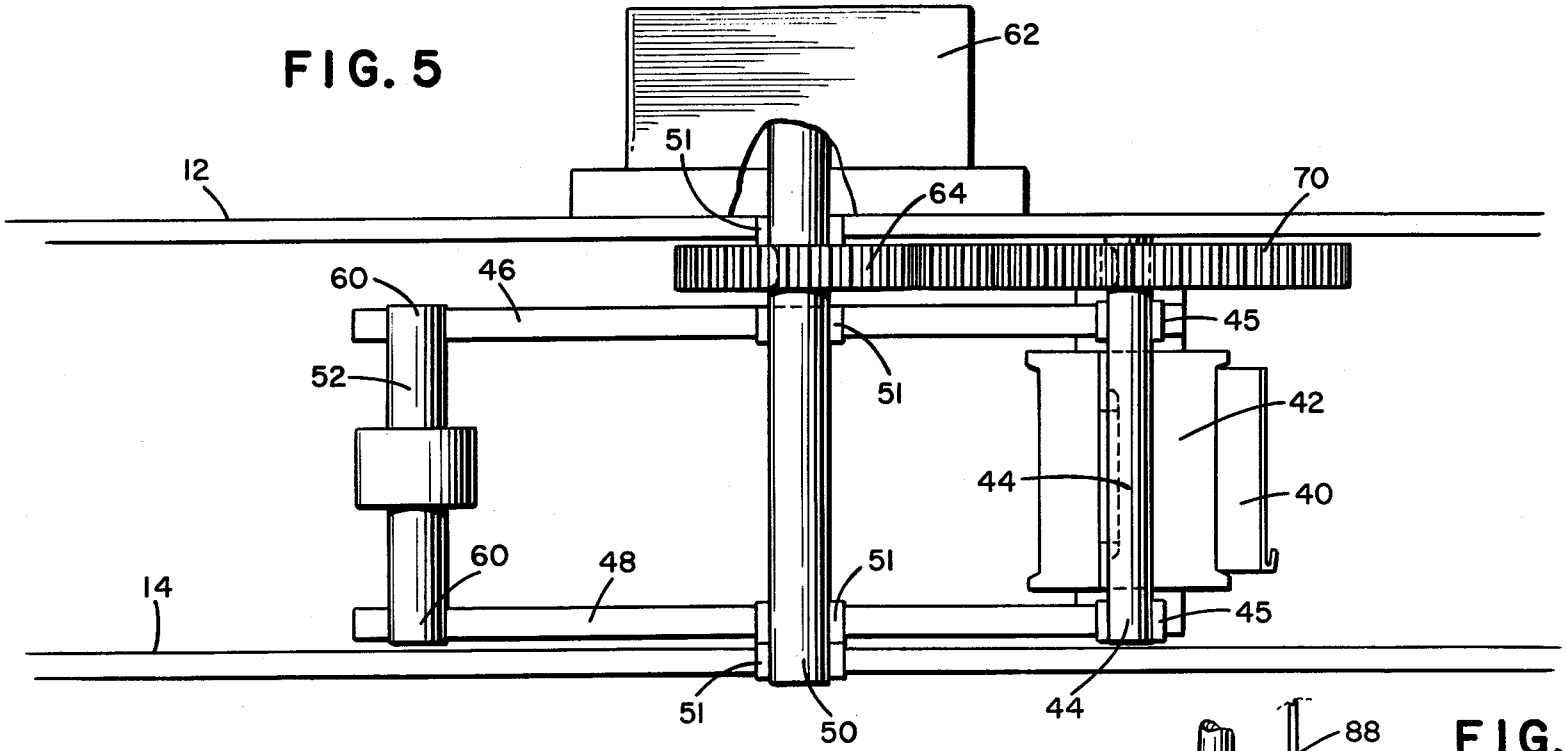
FIG. 5 is an enlarged cross section of a portion of the pipe make up device shown in FIG. 4.

As seen best in FIGS. 3 and 5, shaft 44 is mounted for rotation between an upper arm 46 and a lower arm 48 through the means of bearings 45. Arms 46 and 48 are, in turn, pivotally mounted relative to a motor shaft 50, with bearings 51 being shown at arms 46 and 48, and plates 12 and 14. The ends of the respective arms 46 and 48 opposite the shaft 44 are associated by means of a yoke 52. The ends of yoke 52, shown at 60, extend through apertures in the respective arms 46 and 48 so that the yoke pivots relative to the arms.

An air cylinder 54 (FIG. 3), one side of which is pivotally mounted between top plate 12 and bottom plate 14 through the means of a pivot pin 56, associates with the yoke 52 through the means of its piston rod 58. The piston rod 58 is connected to the yoke 52, as by a bolt shown at 59 in FIG. 4.

The motor shaft 50 is the shaft of an air motor 62 which is fixed on the top plate 12. An air motor drive gear 64 is fixedly mounted on shaft 50 so that when motor 62 drives shaft 50, gear 64 is in turn driven. The gear 64, as seen best in FIGS. 3 and 4, has teeth 66 adapted to mate with corresponding teeth 68 on a driven gear 70 fixed to the shaft 44 above the drive pulley 42.

Figure 2:
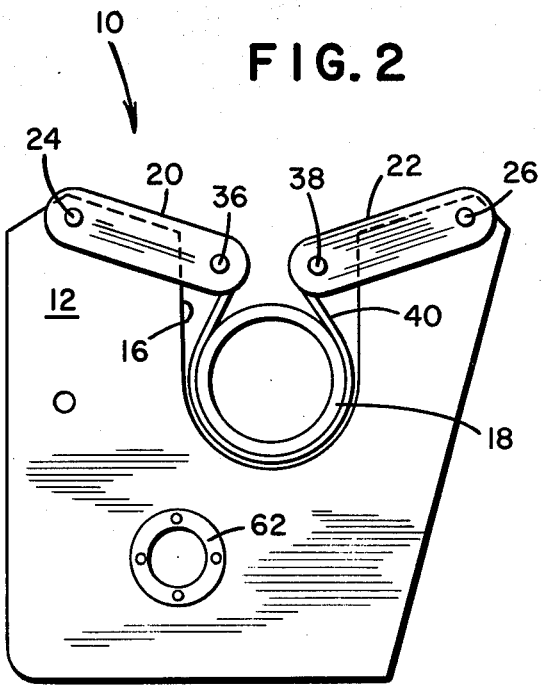
FIG. 2 is a plan view similar to that of FIG. 1, but showing the inventive pipe make up device in association with a section of drill pipe.

With reference now to FIGS. 1 through 3, the operation of the inventive pipe make up device 10 will be described. In FIG. 1, the make up device 10 is illustrated prior to being associated with a section of drill pipe 18. The support arms 20 and 22 have been pivoted about their respective axes 24 and 26 so as to be oriented in the direction of drill pipe 18. The make up device 10 is then moved in the direction of arrow 72 toward drill pipe 18 until the base of the continuous belt 40, shown at 74, comes into contact with the drill pipe. Further movement of the make up device 10 in the direction of arrow 72 results in the support arms 20 and 22 being cammed inwardly until they take the position illustrated in FIG. 2. It should be noted that when so oriented, the drill pipe 18 resides deep in the housing recess 16, with the endless belt 40 contacting the section of drill pipe 18 throughout a major portion of its circumferential surface. In this position, the pulley shafts 36 and 38 lie inside a line between pulley shafts 24 and 26, and are spaced apart by a distance less than the diameter of the drill pipe 18.

The air cylinder 54 is then actuated, and the piston rod 58 is retracted into the air cylinder housing. Through the action of yoke 52, upper arm 46 and lower arm 48 are together pivoted about shaft 50, so that the drive pulley 42 is moved toward the rear of the make up device housing. This action tensions the drive belt 40, and because the pulley shafts 36 and 38 are inside the line between pulley shafts 24 and 26, the belt 40 is made to tightly grip the section of drill pipe 18. It should be noted that when in this orientation, the drill pipe cannot escape from the device 10 until the air cylinder 54 is deactuated, because the distance between pulleys 32 and 34 is less than the diameter of pipe 18.

Air motor 62 is then actuated, turning shaft 50 and hence drive gear 64. It will be recalled that the teeth 66 of drive gear 64 mesh with the teeth 68 of driven gear 70, and hence rotation of the drive gear 64 results in corresponding rotation of the driven gear 70. This rotation of gear 70, fixed on shaft 44 along with the pulley 42, results in rotation of the pulley 42. This rotation of pulley 42 is then transmitted to the drive belt 40, causing the drive belt 40 to move.

Air motor 62 is reversible and hence the drive belt 40 can be moved in a direction either to make up a pipe joint (as shown by arrow 74), or to break the same. And, because an air motor is utilized, once the respective threads of the pipe joint bottom out, the air motor 62 will cease to rotate its drive gear 64.

In tightening a drill pipe joint, the upper section of drill pipe 18 is turned in the direction indicated by arrow 76 in FIG. 3. Throughout the initial stages of tightening, only the drill pipe 18 turns, but once the threads of the pipe joint bottom out, and while the air motor 62 continues to move the drive belt 40 in the direction of arrow 74, a reactive force is developed which causes the entire pipe make up device 10 to turn about the drill pipe 18 in the direction indicated in FIG. 3 by arrow 78. It will be recalled that conventional pipe tongs are mounted on the make up device 10, and therefore rotation of the make up device 10 in the direction of arrow 73 automatically cocks the pipe tongs in readiness for exerting the final tightening torque on the drill pipe joint.

Figure 6:
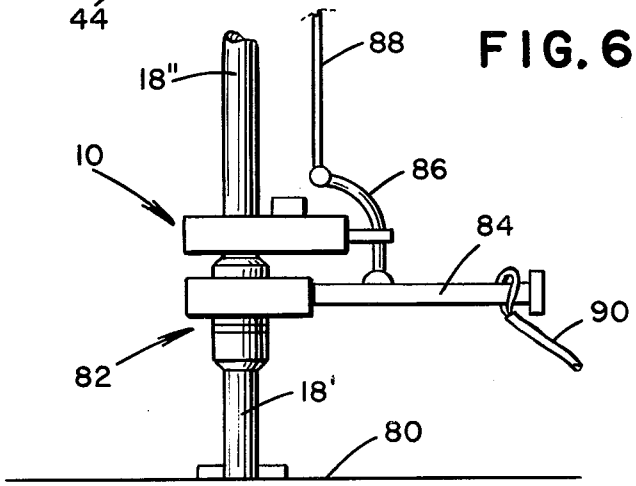
FIG. 6 is a drawing illustrating the inventive pipe make up device combined with conventional pipe tongs and in association with a string of drill pipe at a rig site.
Figure 4:
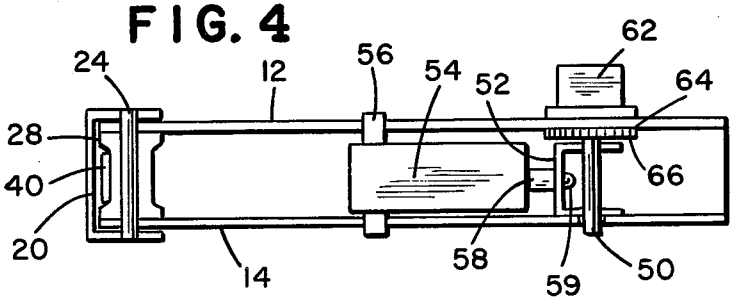
FIG. 4 is a side cross section of the inventive pipe make up device illustrated in FIG. 2.

With reference now to FIG. 6, the inventive make up device 10 can be seen at a drill site. A first section of drill pipe, indicated at 18', extends into the ground 80 at a drill site. A corresponding upper section of drill pipe is shown at 18'' and sits atop pipe section 18'. The joint to be made up is shown generally at 82.

The inventive pipe make up device 10 is attached to conventional rotary tongs 84 by means of a connector mechanism 86, with the make up device 10 and rotary tongs 84 both being suspended by means of a cable 88. A jerk line, connected to a cat (not shown) is illustrated at 90, and is used when applying the final tightening torque to the drill pipe through the means of the pipe tongs 84.

Above, a specific embodiment of the present invention has been described. It should be appreciated, however, that this embodiment was described for purposes of illustration only, without any intention of limiting the scope of the present invention. Rather, it is the intention that the present invention be limited not by the above, but only as is defined in the appended claims.

I claim:

1. A pipe make up device for rotating a section of drill pipe or the like, the device comprising: a frame having a forward portion and a rearward portion; a recess in the forward portion of said frame for receiving said section of pipe; a first elongated arm having one end pivotally mounted about a first pivot axis on the forward portion of said frame at one side of said recess, said first pivot axis being parallel to the rotational axis of said pipe, and enabling the end of said first arm opposite from said first pivot axis to move into and out of said recess; a second elongated arm having one end pivotally mounted about a second pivot axis on the forward portion of said frame at the opposite side of said recess, said second pivot axis being parallel to the rotational axis of said pipe and enabling the end of said second arm opposite from said second pivot axis to move into and out of said recess; first and second guide means mounted on the respective ends of said first and second arms remote from said first and second pivot axes; an endless belt mounted for movement in said frame, and extending between said first and second guide means and into said recess; drive means for moving said endless belt; and means contacting said belt for tensioning said belt and thereby causing said first and second arms to pivot about their respective pivot axes so that said first and second guide means are urged into said recess; wherein said first and second arms are positioned and dimensioned so that the distance between said first and second guide means is substantially less than the width of said recess, and so that said first and second guide means are more rearward than the respective first and second pivot axes, when said first and second guide means are in said recess during a pipe spinning operation.

2. In a pipe make up device wherein a drill pipe or the like is rotated by means of a driven endless belt guided by guides on a pair of pivotal support arms mounted on a main frame, the improvement comprising the provision of: a recess in the main frame for receiving the pipe to be rotated; the pivot axes of said support arms located on opposite sides of said recess; guide means mounted on the ends of said support arms opposite their respective pivot axes for guiding said driven belt; and means for tensioning said belt and causing said arms to pivot about said axis thereby urging the ends of the respective support arms supporting said guide means into said recess; and wherein said support arms are positioned and dimensioned so that said guide means reside more rearward than said pivot axes and are spaced apart by a distance substantially less than the width of said recess when the pipe make up device is rotating pipe.

3. In combination with conventional pipe tongs, a pipe make up device comprising: a frame having a forward portion, a rearward portion and side portions; a recess in the forward portion of said frame for receiving the pipe to be rotated; first and second support arms pivotally mounted on the respective forward sides of said frame; belt guide means mounted on the ends of said support arms remote from the pivot axes thereof; an endless belt guided around said belt guide means and into said recess for contacting a pipe to be rotated; means for moving said endless belt; and means for urging said belt guide means into said recess when a pipe is being rotated; wherein said endless belt is adapted to extend from one belt guide means, around said pipe to the other belt guide means; and wherein the belt guide means are more rearward than the pivot axes of said support arms and the distance between the belt guide means is less than the width of said recess when the pipe make up device is rotating pipe.

4. A pipe make up device for rotating drill pipe or the like, the device comprising: a frame having a forward portion, a rearward portion and side portions; a recess in the forward portion of said frame for receiving the pipe to be rotated; first and second support arms pivotally mounted on the respective forward sides of said frame; first and second belt guide means mounted on the respective ends of said first and second support arms remote from the pivot axes thereof; an endless belt guided around said first and second belt guide means and into said recess; drive means for moving said endless belt; and lock means for urging said first and second belt guide means into said recess when a pipe is being rotated; wherein said endless belt is adapted to extend from said first guide means, around said pipe to said second guide means; and wherein the first and second belt guide means are more rearward than the pivot axes of said first and second support arms and the distance between said first and second belt guide means is less than the width of said recess when the pipe make up device is rotating pipe.

5. The pipe make up device recited in claim 4, wherein said first and second belt guide means are pulleys mounted on shafts on the respective first and second support arms remote from the pivot axes thereof.

6. The pipe make up device recited in claim 5, and further comprising third and fourth belt guide means mounted on said frame adjacent the respective pivot axes of said first and second support arms; and wherein said endless belt is guided from the respective first and second belt guide means toward the sides of said frame by means of said third and fourth guide means.

7. The pipe make up device recited in claim 6, and further comprising fifth belt guide means mounted in the rearward portion of said frame for guiding said endless belt from said third belt guide means to said fourth belt guide means.

8. The pipe make up device recited in claim 7, wherein said fifth belt guide means serves as said drive means.

9. The pipe make up device recited in claim 4, wherein said drive means is an air motor.

10. The pipe make up device recited in claim 4, wherein said lock means is operative through the means of said endless belt.

11. The pipe make up device recited in claim 10, wherein said drive means is a driving belt guide means; and wherein said lock means serves to move said driving belt guide means toward the rearward portion of said frame to tighten said endless belt.

12. The pipe make up device recited in claim 11, wherein said lock means is an air cylinder actuatable for tensioning said belt.

13. The pipe make up device recited in claim 11, wherein said driving belt guide means is mounted on an arm linkage; and wherein said lock means serves to actuate said arm linkage for moving said driving belt guide means toward the rearward portion of said frame.

14. The pipe make up device recited in claim 13, wherein said lock means is an air cylinder.

15. A pipe make up device for rotating a section of drill pipe or the like, the device comprising: a frame having a forward portion for receiving the pipe to be rotated, a rearward portion and side portions; a recess in the forward portion of said frame; first and second belt support arms mounted at the respective forward sides of said frame, each of said first and second arms being pivotally mounted on said frame at one end thereof, including a belt guide at the opposite end thereof, and adapted to pivot so that in a first position, the belt guide resides outside said recess and in a second position the belt guide resides inside said recess; a driven endless belt extending from the rearward portion of said frame, around one of said belt guides, into said recess, around the other of said belt guides, and back to the rearward portion of said frame; and means for driving said endless belt; said first and second support arms being positioned and dimensioned so that when in said first position, the distance between the belt guides is at least the width of said recess, so that when in said second position, the distance between said belt guides is substantially less than the width of said recess, and so that when in said second position, the belt guides are more toward the rearward portion of said frame than the respective pivot axes of said support arms.

* * * * *